US008322531B2

(12) United States Patent
Miller et al.

(10) Patent No.: US 8,322,531 B2
(45) Date of Patent: Dec. 4, 2012

(54) TWIN BLADE KNIFE PACKAGE

(75) Inventors: Jonathan Miller, Burlington, CT (US); Gary Wainwright, Sheffield (GB)

(73) Assignee: Stanley Black & Decker, Inc., New Britain, CT (US)

( * ) Notice: Subject to any disclaimer, the term of this patent is extended or adjusted under 35 U.S.C. 154(b) by 107 days.

(21) Appl. No.: 12/774,455

(22) Filed: May 5, 2010

(65) Prior Publication Data

US 2011/0272309 A1 Nov. 10, 2011

(51) Int. Cl.
*B65D 85/00* (2006.01)

(52) U.S. Cl. ..... 206/553; 206/493; 206/495

(58) Field of Classification Search ..... 206/349, 206/553, 495, 471, 493, 478, 460, 806, 481; 30/162, 335
See application file for complete search history.

(56) References Cited

U.S. PATENT DOCUMENTS

| | | | | | |
|---|---|---|---|---|---|
| 2,226,409 | A | * | 12/1940 | Patterson et al. | 206/478 |
| 2,338,007 | A | * | 12/1943 | Morris | 30/351 |
| 2,771,188 | A | | 11/1956 | Coulter | 206/553 |
| 2,874,836 | A | * | 2/1959 | Wertepny, Jr. | 206/470 |
| 3,067,866 | A | | 12/1962 | Burton | 206/349 |
| 3,104,172 | A | * | 9/1963 | Wizelman | 426/119 |
| 3,130,833 | A | * | 4/1964 | Glasser et al. | 206/460 |
| 3,135,384 | A | * | 6/1964 | Cozzolino | 206/460 |
| 3,278,020 | A | | 10/1966 | Murphy | 206/481 |
| 3,674,138 | A | * | 7/1972 | Gilmour | 206/349 |
| 3,891,088 | A | | 6/1975 | Huebner | 206/349 |
| 3,963,123 | A | * | 6/1976 | Beal | 206/495 |
| 4,174,037 | A | * | 11/1979 | Chow | 206/378 |
| 4,573,576 | A | * | 3/1986 | Krol | 206/471 |
| 4,578,865 | A | | 4/1986 | Keller | 30/304 |
| 4,682,690 | A | * | 7/1987 | Tiffany | 206/305 |
| 4,770,293 | A | * | 9/1988 | Craig | 206/564 |
| 5,018,253 | A | * | 5/1991 | Oppenheimer | 24/458 |
| 5,064,056 | A | * | 11/1991 | Gresh | 206/321 |
| 5,234,106 | A | * | 8/1993 | Transue et al. | 206/363 |
| 5,337,481 | A | | 8/1994 | Mears | 30/162 |
| 5,501,330 | A | * | 3/1996 | Betts | 206/349 |
| 5,626,226 | A | | 5/1997 | Gardiner et al. | 206/349 |
| 5,649,621 | A | * | 7/1997 | Brody | 206/349 |
| 5,813,546 | A | * | 9/1998 | Wilson et al. | 211/32 |
| 5,896,991 | A | * | 4/1999 | Hippely et al. | 206/461 |
| 6,148,522 | A | * | 11/2000 | Dobandi | 30/162 |
| 6,481,182 | B1 | * | 11/2002 | Fuller | 53/399 |
| 6,550,143 | B1 | | 4/2003 | Derome | 30/162 |
| 6,681,932 | B2 | * | 1/2004 | Bradfield | 206/349 |
| 7,131,535 | B2 | | 11/2006 | Hernandez, Jr. et al. | 206/349 |
| 7,243,796 | B2 | * | 7/2007 | Grablick | 206/460 |
| 7,344,026 | B2 | * | 3/2008 | Melgaard | 206/349 |
| 7,344,118 | B2 | * | 3/2008 | Samberg | 248/690 |

(Continued)

*Primary Examiner* — David Fidei
(74) *Attorney, Agent, or Firm* — Pillsbury Winthrop Shaw Pittman LLP

(57) ABSTRACT

A knife package includes a card having a front side and a back side. The knife package further comprises a utility knife having a body and a plurality of blade holders movable within the body, and a plurality of slides on the body. Each slide is operatively connected with one of the blade holders, and the slides are arranged to move associated blade holders in the body. The knife package further comprises a securement structure that secures the utility knife to the card, wherein said utility knife is secured on the front side of said card by the securement structure such that the plurality of slides of the utility knife are visible when viewing the front side of the card from an angle normal to the front side of the card.

21 Claims, 10 Drawing Sheets

U.S. PATENT DOCUMENTS

| | | | | |
|---|---|---|---|---|
| 7,958,604 | B2 * | 6/2011 | Wong et al. | 24/198 |
| 2002/0100704 | A1 * | 8/2002 | Huang | 206/349 |
| 2004/0118724 | A1 | 6/2004 | Leventhal et al. | 206/352 |
| 2006/0113205 | A1 * | 6/2006 | Liu | 206/349 |
| 2008/0190796 | A1 | 8/2008 | Clark | 206/349 |
| 2009/0065386 | A1 | 3/2009 | Hasegawa | 206/349 |
| 2009/0288971 | A1 * | 11/2009 | Webb et al. | 206/354 |

* cited by examiner

TWIN BLADE KNIFE PACKAGE

FIELD OF THE INVENTION

The present invention relates to utility knives and knife packaging.

SUMMARY OF THE INVENTION

A knife package is disclosed. The knife package includes a card having a front side and a back side; a utility knife having a body, a plurality of blade holders movable within the body, and a plurality of slides on the body, each slide operatively connected with one of the blade holders, the slides being arranged to move associated blade holders in the body; and a securement structure that secures the utility knife to the card, wherein said utility knife is secured on the front side of said card by the securement structure such that the plurality of slides are visible when viewing the front side of the card from an angle normal to the front side of the card.

In another aspect, the knife package includes a card having a front side, a back side, and at least two holes; a knife having a plurality of knife blade openings; and a retaining member having tabs configured to be inserted through said holes in the card and into said knife blade openings to secure said knife along said card.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein may be considered to be drawn to scale. It is to be expressly understood, however, that the drawings are for the purpose of illustration and description only and are not a limitation of the invention. In addition, it should be appreciated that structural features shown or described in any one embodiment herein can be used in other embodiments as well. As used in the specification and in the claims, the singular faun of "a", "an", and "the" include plural referents unless the context clearly dictates otherwise.

DETAILED DESCRIPTION OF THE INVENTION

Figure 1:
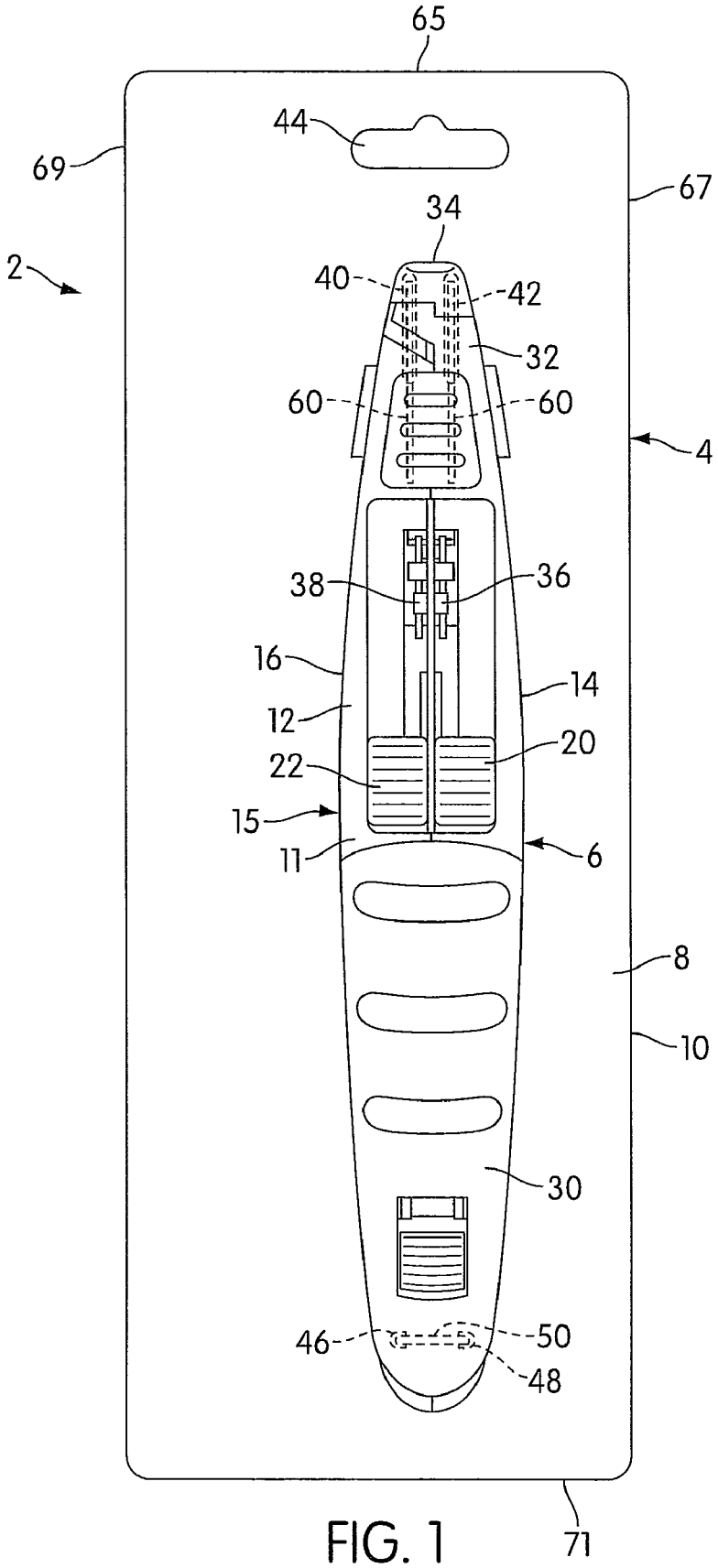
FIG. 1 is a perspective view of a twin blade knife package in accordance with an embodiment of the present invention.

FIG. 1 shows a knife package 2 in accordance with an embodiment of the present invention. The knife package 2 includes a display card 4 and a utility knife 6. The knife package 2 also includes a securement structure that secures the knife to the card in a desired relative orientation for sale. After the knife package 2 is purchased by a consumer, the securement structure (as will be described) is cut or otherwise manipulated to release knife 6 from the card 4.

The securement structure can take many different forms and combinations thereof. For example, the securement structure may take the form of a retaining member (described below), a clear plastic wrap covering the knife and attached to surrounding portions of the card 4, a blister pack comprising front and back clear plastic portions connected to one another and encapsulating the card 4 and knife 6, a plastic wire tie extending through holes in the card 4 and capturing the knife, a twistable metal based wire tie (as also described below), an adhesive, or any combination thereof, just for example.

Display card 4 has a front side 8, back side 10 (obstructed from view by front side 8), a top edge 65, a right edge 67, a left edge 69, and a bottom edge 71. Card 4 also has an opening 44 so that card 4 may be hung on a rack (not shown). In some embodiments, for example the embodiment shown in FIG. 10, the card 4 may have two layers or portions, and the front side 8 may be defined on a front portion 25 of the card 4 and the back side 10 may be defined on a back portion 27 of the card 4. Alternatively, in some embodiments, the card 4 may only have one layer or portion. In one embodiment, such as the embodiment shown in FIGS. 7-10, the opening 44 may be positioned to be offset from the center of the card 4 in the horizontal direction (e.g., the opening 44 is closer to the right edge 67 than the left edge 69 of the card 4). It should be appreciated that card 4 may be made out of cardboard, plastic, metal or any other material of suitable strength to mount knife 6 thereon.

Figure 2:
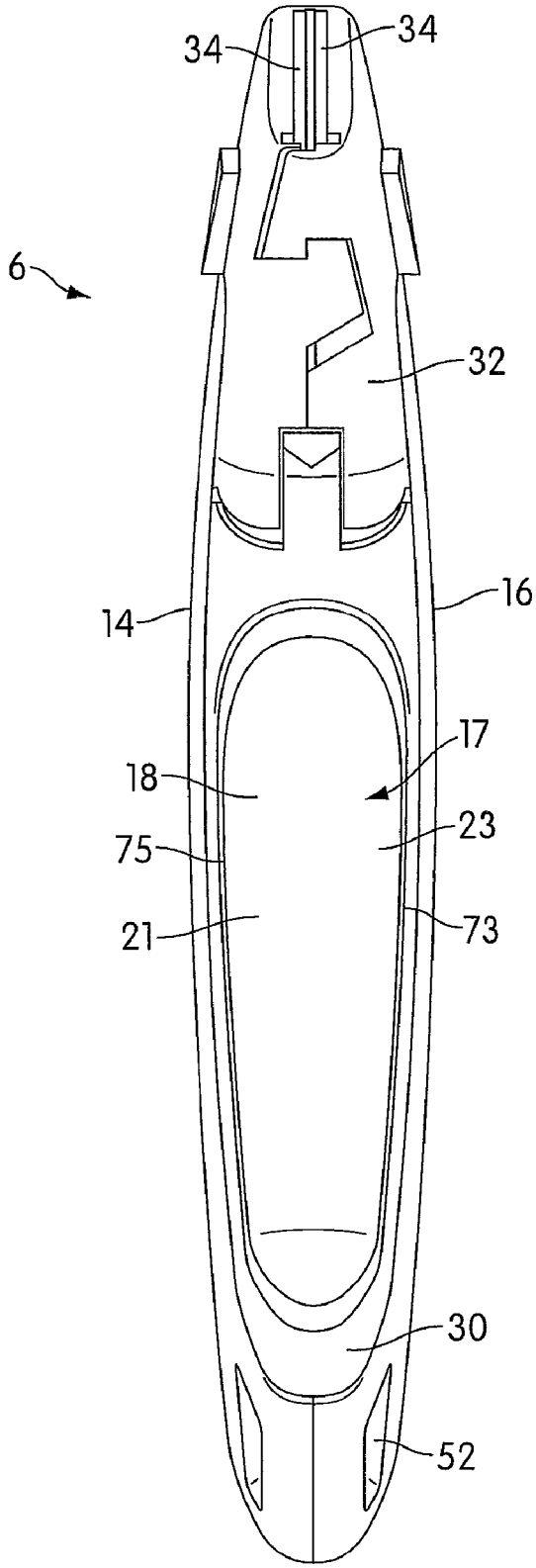
FIG. 2 is a perspective view of a bottom side of a utility knife in accordance with an embodiment of the present invention.

In the embodiment shown in FIG. 1, knife 6 has a body 11. The body 11 has a main portion 15 and a bottom portion 17 (see FIG. 2). Referring to FIG. 1, the main portion 15 has a top surface 12, a right side surfaces 14, and a left side surface 16, and the bottom portion 17 has a bottom surface 18 (shown in FIG. 2). The top surface 12 is located on a top side 13 of the body 11. The main portion 15 may be made of plastic, metal (e.g., aluminum or steel), wood, or other materials. The bottom portion 17 may optionally be made of a suitable molded plastic material and coated with a layer of elastomeric materials, such as rubber. As shown in FIG. 2, the bottom portion 17 has a right side 21 and a left side 23. The bottom portion 17 is constructed and arranged to connect to the main portion 15. Specifically, in one embodiment, the right side 21 of the bottom portion 17 is connected to the right side surface 14 of the main portion 15 at a right edge 75 (see FIG. 2). Similarly, the left side 23 of the bottom portion 17 is connected to the left side surface 16 of the main portion 15 at a left edge 73 (see FIGS. 2 and 9). The left edge 73 (see FIGS. 2 and 9) and the right edge 75 (see FIG. 2) may have similar construction.

Figure 3A:
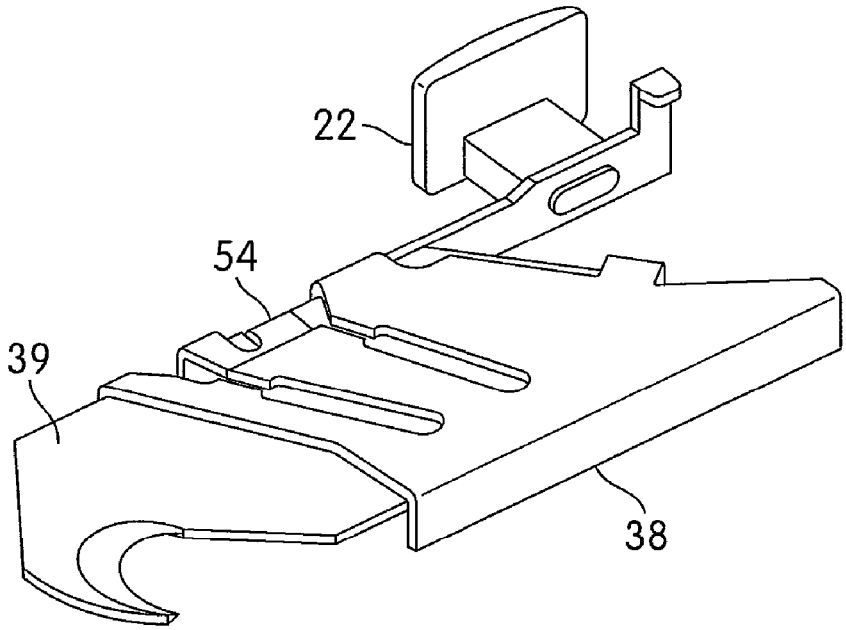
FIGS. 3A and 3B are perspective views of slides and blade holders in accordance with an embodiment of the present invention.
Figure 3B:
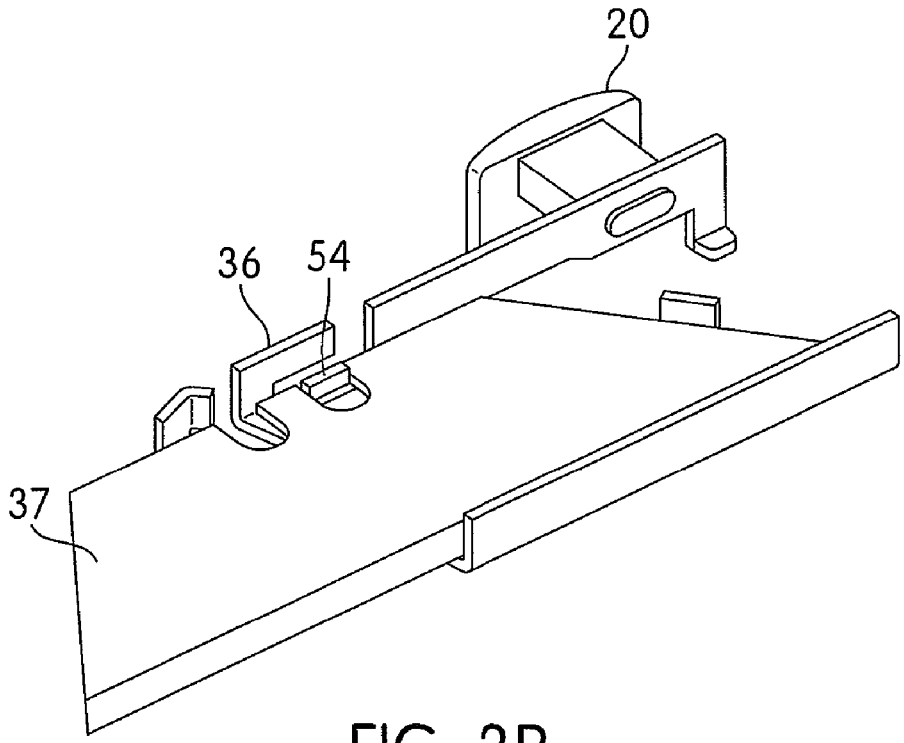

Referring back to FIG. 1, knife 6 includes a rearward handle portion 30 and a front portion 32. Front portion 32 has forward end with a plurality (in this case two) of knife blade openings 34 (shown in FIG. 2). Knife 6 has a plurality of slides 20 and 22 along the top surface 12. First blade holder 36 and second blade holder 38 may be positioned in the body 11 between top surface 12, side surfaces 14 and 16, and bottom surface 18. Slides 20 and 22 are operatively connected with blade holders 36 and 38, respectively (as shown in FIGS. 3A and 3B). Slide 20 operates movement of a blade holder 36 and slide 22 operates movement of a blade holder 38. Sliding movement of the slide 20 can move blade holder 36 so that a blade mounted thereon can be moved between a stored position within the body 11 and deployed position wherein a blade protrudes outside of knife blade opening 34. Similarly, sliding movement of the slide 22 can move blade holder 38 so that a blade thereon can be moved between a stored position within the body 11 and deployed position wherein a blade protrudes outside of the second knife blade opening 34. The blades carried by the two blade holders, in one embodiment, have the large planar surfaces of each disposed in parallel to one another when disposed inside the knife body 11.

In one embodiment, the utility knife 6 correspond to the knives disclosed in U.S. patent application Ser. No. 12/365,718, hereby incorporated by reference in its entirety. It should be appreciated, however that the present invention is not at all limited to the knives specifically disclosed therein, and that any multi-blade utility knives can be utilized.

Figure 8:
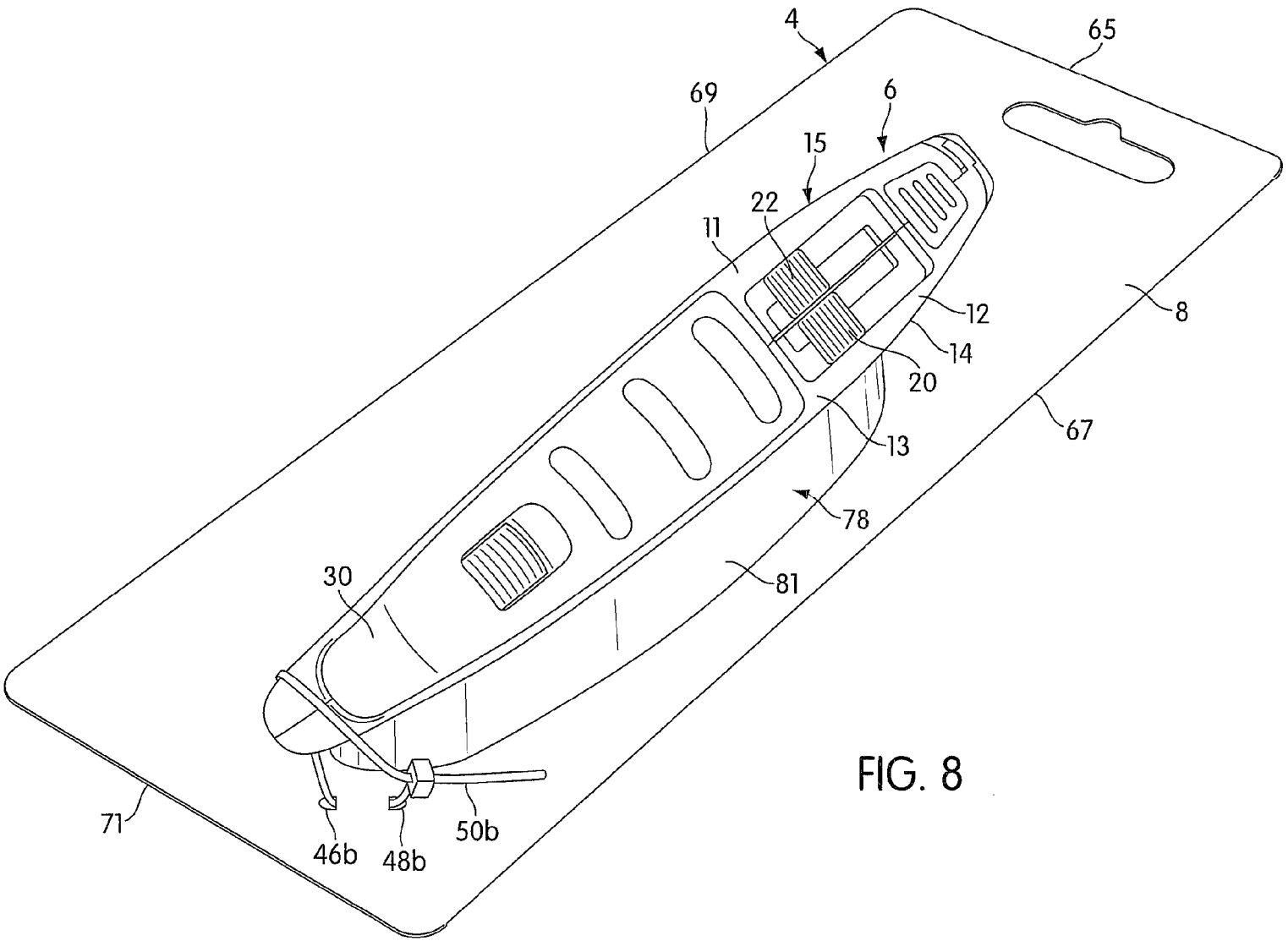
FIG. 8 a perspective view of a twin blade knife package in accordance with an embodiment of the present invention.

The utility knife 6 is secured to card 4 such that the top surface 12 is visible when viewing the front side 8 of the card 4 from an angle normal to the front side 8 of the card 4. Thus, slides 20 and 22 are highly visible to a potential customer, allowing the potential customer to quickly discern that knife 6 has a plurality of slides (at least two) and is configured to retain a plurality of blades and move the blades between a stored position and a deployed position. In the embodiment shown in FIG. 1, the top surface 12 faces substantially the same direction as front side 8 of card 4. In other embodiments, the top surface 12 of the knife 6 may be at an angle relative to the front side 8 of the card 4, for example, as shown in FIG. 8.

FIG. 2 shows the bottom side 18 of an embodiment of knife 6. As shown, knife blade openings 34 are on the front portion 32. A through-hole 52 is in the handle portion 30.

FIG. 3A shows slide 22 operatively connected to blade holder 38. Blade holder 38 is configured to hold a blade, such as blade 39. FIG. 3B shows slide 20 operatively connected to blade holder 36. Blade holder 36 is configured to hold a blade, such as blade 37. As shown, blade holders 36 and 38 each have a blade retaining projection 54. The blade retaining projection 54 may be integrally formed as part of the blade holders 36 and 38.

Figure 4:
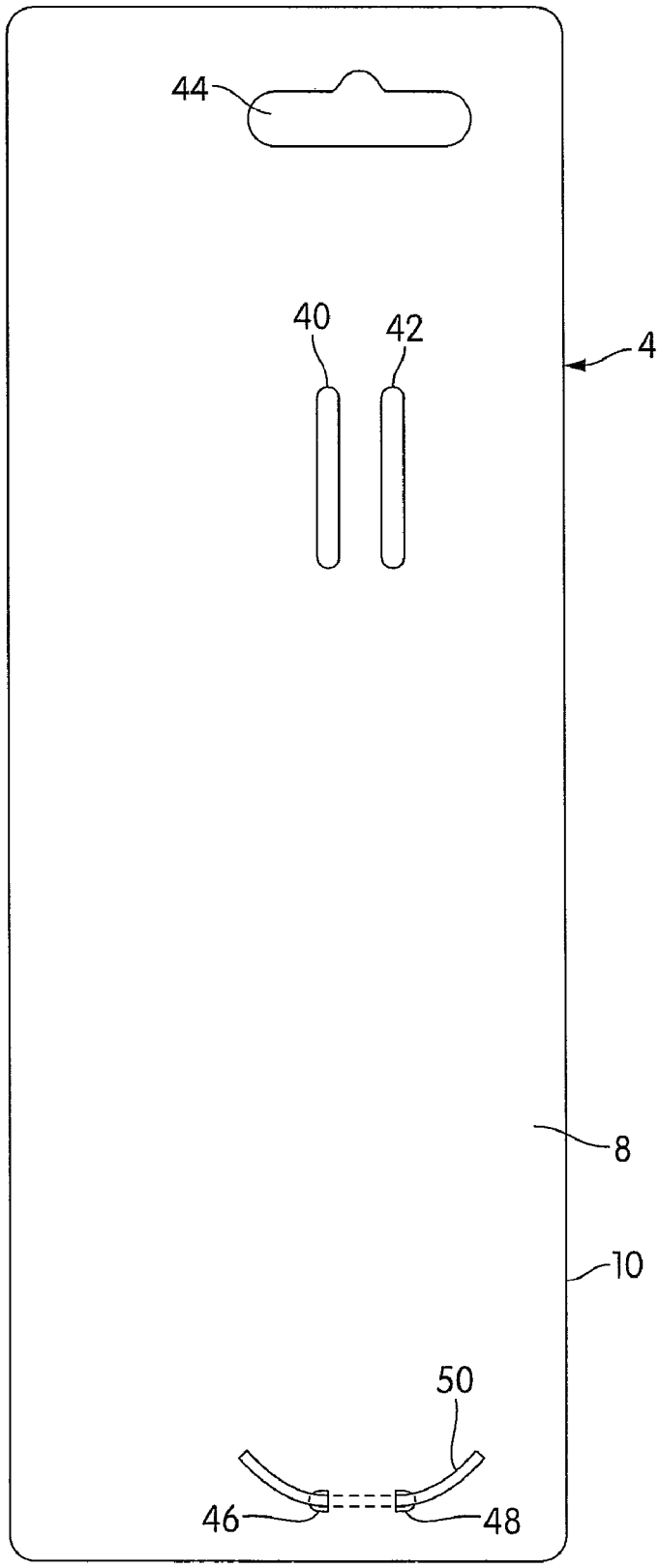
FIG. 4 is a front view of a display card with holes that permit a utility knife to be secured in accordance with an embodiment of the present invention.

FIG. 4 illustrates one embodiment of display card 4 configured to have utility knife 6 (shown in FIGS. 1 and 2) secured thereto. Card 4 has two holes or slots 40 and 42. Card 4 also has a pair of holes 46 and 48. Securement structure(s) can be used to secure the utility knife rear end to the card 4 via the holes 40 and 42 and/or holes 46 and 48. For example, a securement structure in the form of a tie 50 can be configured to be threaded through both holes 46 and 48 and positioned in surrounding relation to the knife body 11 (or through a hole in the knife body), and then twisted or tied to secure knife 6 to card 4. It should be appreciated that tie 50 may be made from a flexible plastic, flexible metal wire with memory retention, and/or twine material.

Figure 5:
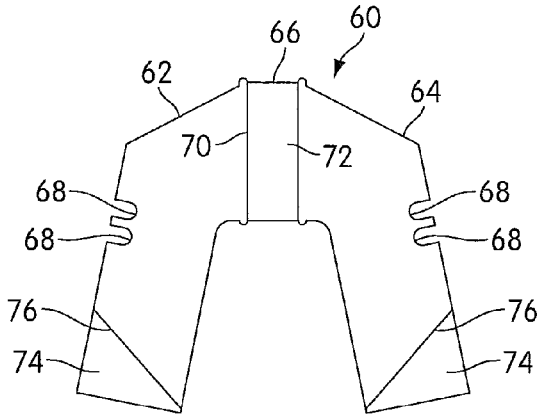
FIG. 5 is a top view of a retaining member configured to secure a utility knife to a display card in a desired relative orientation for sale in accordance with an embodiment of the present invention.

FIG. 5 illustrates a securement structure 60. In the illustrated embodiment, the securement structure takes the form of a retaining member 60 having tabs 62 and 64 and center portion 66. Tabs 62 and 64 and center portion 66 form a one-piece unitary structure. Retaining member 60 has creases, or folds 70 and 72. Tabs 62 and 64 each have indentations 68 to engage the blade holders 36 and 38 (shown in FIGS. 3A and 3B), normally used for holding blades. Tabs 62 and 64 each have an end 74 that may be folded along crease 76. When ends 74 are folded along creases 76, tabs 62 and 64 each form a trapezoidal shape that substantially resembles the shape of a blade to be carried by blade holders 36 and/or 38. When ends 74 are folded back against tabs 62 and 64, ends 74 may serve to thicken tabs 62 and 64 to better forcibly engage knife 6 when tabs 62 and 64 enter knife blade openings 34 (discussed in more detail below). It should be appreciated that in one embodiment tabs 62 and 64 may not have ends 74. In such an embodiment, tabs 62 and 64 may be cut-off along creases 76. It should be appreciated that retaining member 60 may be made out of cardboard, paper, plastic, metal, or other suitable material of suitable strength and flexibility.

Figure 6:
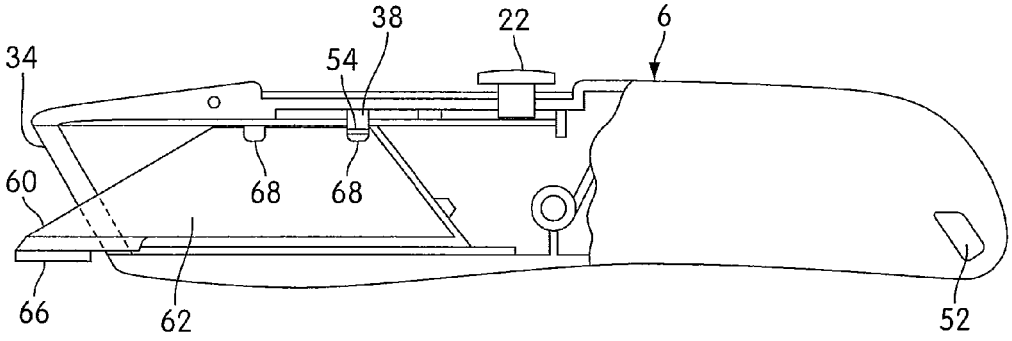
FIG. 6 is a side view of the interior of a utility knife with a retaining member engaged to a blade holder in accordance with an embodiment of the present invention.

FIG. 6 shows tab 62 of retaining member 60 inserted through knife blade opening 34. One of indentations 68 receives a blade retaining projection 54 portion of blade holder 38. Similarly, tab 64 (shown in FIG. 5) may engage a blade retaining projection 54 portion of blade holder 36 (shown in FIG. 3B).

Referring back to FIG. 1, in one embodiment, to mount knife 6 on card 4 such that top surface 12 faces substantially the same direction as front side 8, tab 62 (shown in FIG. 5) and 64 (shown in FIG. 5) may be folded along creases 70 (shown in FIG. 5) and 72 (shown in FIG. 5), respectively, such that tabs 62 and 64 are substantially perpendicular to center portion 66 (shown in FIG. 5). When tabs 62 and 64 are substantially perpendicular to center portion 66, retaining member 60 is in a generally 'U' shape configuration. Knife 6 may be placed on card 4 such that knife blade openings 34 (shown in FIG. 2) face the top edge 65 of card 4. Tab 62 may be inserted through elongated hole 40 (shown in FIG. 4) from the back side 10. Tab 64 may be inserted through elongated hole 42 (shown in FIG. 4), also from the back side 10 of card 4. Ends 74 (shown in FIG. 5) may be folded back against tabs 62 and 64 along creases 76 (shown in FIG. 5). Tabs 62 and 64 may be inserted through blade openings 34 (shown in FIG. 2) at the front end of the knife body 11 such that indentations 68 (shown in FIG. 5) engage blade retaining projections 54 (shown in FIGS. 3A and 3B) of the blade holders 36 and 38. Another securement structure in the than of a tie 50 (shown in FIG. 4) may tie the handle portion 30 to card 4. The handle portion 30 may optionally contain a through hole 52 (shown in FIG. 2) that tie 50 may be inserted through to secure the handle portion 30 to card 4. While two securement structures are shown in this embodiment, it is contemplated that only one, or more than two may be used.

Figure 7:
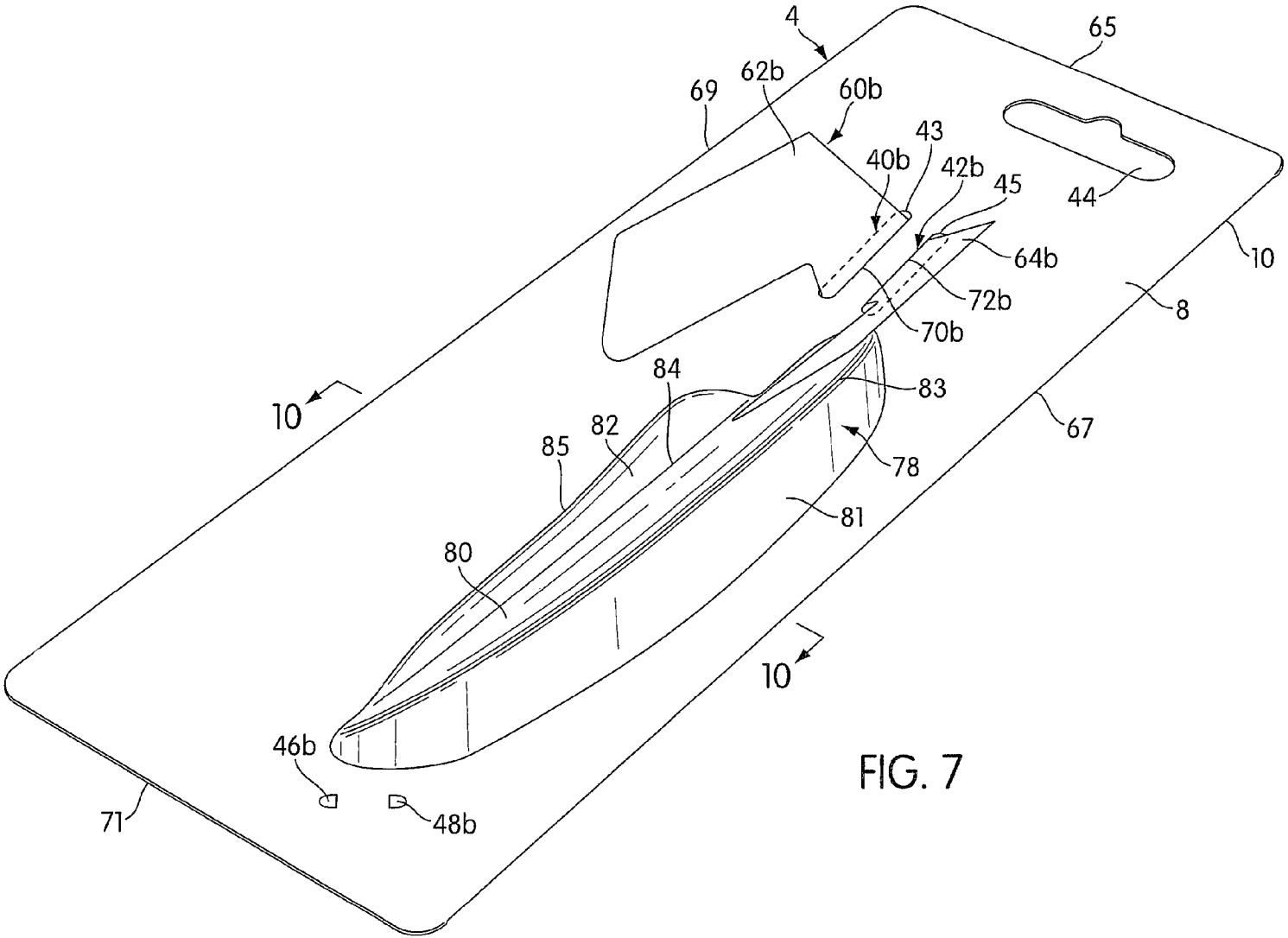
FIG. 7 is a perspective view of the card, retaining member, and a support structure in accordance with another embodiment of the present invention.
Figure 9A:
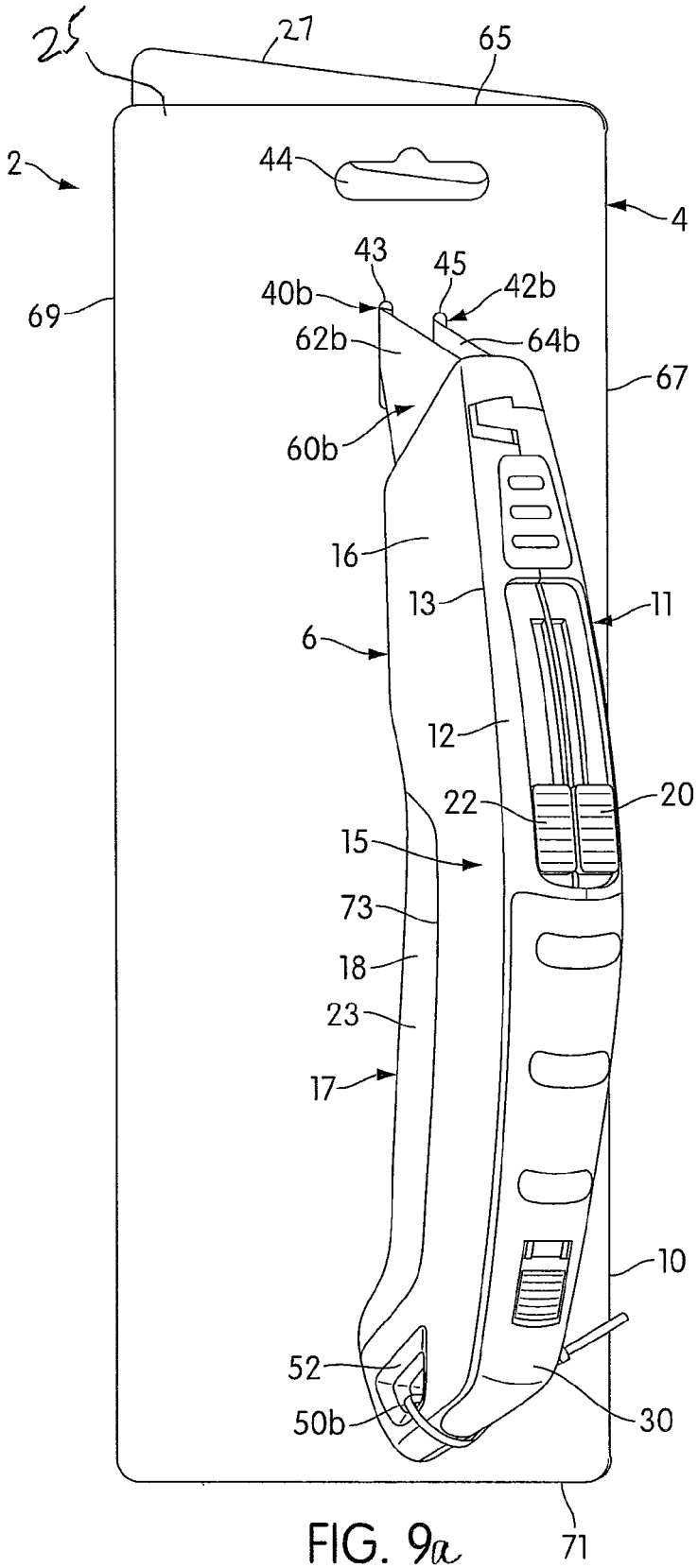
FIGS. 9*a*-9*b* are front views of a twin blade knife package in accordance with an embodiment of the present invention.
Figure 9B:
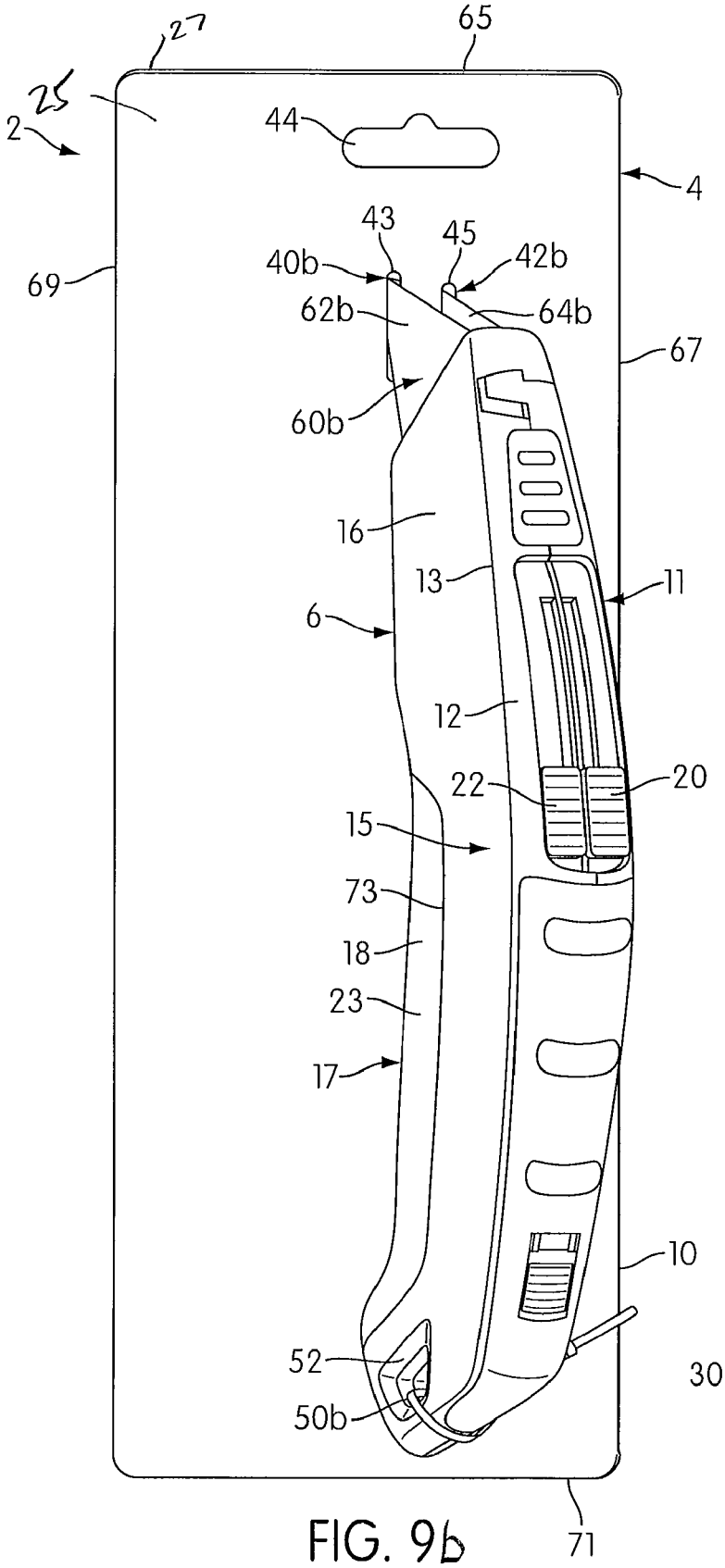

FIG. 7 illustrates another embodiment of display card 4 configured to have utility knife 6 (shown in FIGS. 1, 2, and 8) secured thereto. Card 4 has two holes 40*b* and 42*b*. In the illustrated embodiment, the holes 40*b* and 42*b* are similar in shape and size and are longitudinally aligned and spaced less than ¾" apart. However, the illustrated embodiment is not intended to be limiting, and it is contemplated that the holes 40*b* and 42*b* may be positioned elsewhere and at various distances relative to one another. In the illustrated embodiment, upper edge 43 of the hole 40*b* is located closer to the top edge 65 of the card 4 than upper edge 45 of the hole 42*b*. Such positioning of the holes 40*b*, 42*b* may help retain the knife 6 in the position as shown in FIGS. 9*a*-9*b*, which will be described in more detail later. The card 4 may also have a support structure 78 constructed and arranged to support at least a portion of the knife 6 when the knife 6 is secured to the card 4. In the illustrated embodiment, the support structure is a blister pack 78 constructed of clear plastic material. In other embodiments, the support structure 78 may be made of cardboard, rubber, or other materials that enable the support structure 78 to support the knife 6. The blister pack 78 may have an inclined portion 80 and a protruding portion 82. A groove 84 may be defined between the inclined portion 80 and the protruding portion 82.

Figure 10:
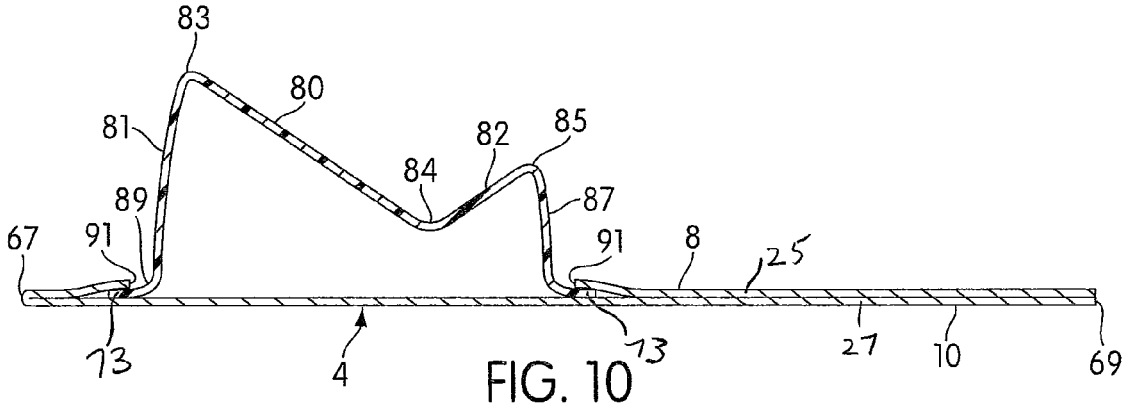
FIG. 10 is a cross sectional view of the support structure, as seen along lines 10-10 in FIG. 7, in accordance with an embodiment of the present invention.

The shape of one embodiment of the blister pack 78 can be seen in FIG. 10, which is a cross sectional view of the blister pack 78, as seen along line 10-10 in FIG. 7. In the embodiment shown in FIG. 10, a first side edge 81 is constructed and arranged to extend upwardly from the card 4 to connect to the inclined portion 80 at corner 83. The inclined portion 80 is constructed and arranged to extend downwardly from the corner 83 towards the groove 84. As mentioned above, the groove 84 is formed between the inclined portion 80 and the protruding portion 82. The protruding portion 82 is constructed and arranged to extend upwardly from the groove 84 towards a corner 85. The second side edge 87 is constructed and arranged to extend upwardly from the card 4 to connect to the protruding portion 82 at the corner 85. As shown in the illustrated embodiment, the corner 85 is positioned at a greater distance from the top surface 8 of the card 4 than the groove 84, and the corner 83 is positioned at a greater distance from the top surface 8 of the card 4 than the corner 85.

In the illustrated embodiment, a die cut opening 89 is formed on the front portion 25 of the card 4. Edge 91 of the front portion 25 of the card 4 may define the shape of the die cut opening 89, which may be in the shape of the blister pack 78. The die cut opening 89 is constructed and arranged to enable an extending portion 73 of the blister pack 78 material to extend between the front portion 25 and the back portion 27 of the card 4 to be retained therebetween. In one embodiment, the extending portion 73 may be a flat piece of plastic material having a thickness substantially similar to that of the front portion 25 or the back portion 27 of the card 4. It is contemplated that the extending portion 73 may extend further between the front portion 25 and the back portion 27 than illustrated. For example, the extending portion 73 may be constructed and arranged to extend to edge 69 and to edge 67. It is contemplated that in some embodiments, a similar die cut opening may also be formed in the back portion 27 of the card 4.

In the illustrated embodiment, the front portion 25 of the card 4 and the back portion 27 of the card 4 is a unitary structure (e.g., one piece of material) folded at edge 67 to form the front portion 25 and the back portion 27. Alternatively, in some embodiments, the front portion 25 of the card 4 and the back portion 27 of the card 4 may be separate pieces.

When the knife 6 is attached to the card 4, the knife 6 may be positioned such that at least a portion of the knife 6 is disposed on the protruding portion 82 of the blister pack 78 and at least a portion of the knife 6 is disposed on the inclined portion 80 of the blister pack 78. For example, in the embodiment illustrated in FIG. 8, at least a portion of the right side 14 of the knife 6 is supported by the inclined portion 80 (obstructed from view by the knife 6) of the blister pack 78 and at least a portion of the right side 21 of the bottom surface 18 of the knife 6 is supported by the protruding portion 82 (obstructed from view by the knife 6) of the blister pack 78. A portion of the knife body 11 near the right edge 75 (see FIG. 2) may optionally contact the groove 84 of the blister pack 78. This configuration of the blister pack 78 described above enables the knife 6 to be supported thereon when the knife 6 is secured to the card 4, as shown in FIGS. 8 and 9.

Referring back to FIG. 7, card 4 also has a pair of holes **46*b* and 48*b*. Hole 46*b* may be positioned to the lower left of hole 48*b*. In one embodiment, securement structure in the form of a tie 50*b* (see FIG. 8) can be configured to be threaded through both holes 46*b* and 48*b* and positioned in surrounding relation to the knife body 11 (or through a hole in the knife body 11), and then twisted or tied to secure knife 6 to card 4. Holes 46*b* and 48*b* may be formed by aligning openings provided on the front portion 25 of the card 4 and the back portion 27 of the card such that the tie 50*b* inserted through holes 46*b* and 48*b* is inserted through both the front portion 25 and the back portion 27 of the card 4. It should be appreciated that tie 50*b* may be similarly constructed as tie 50** mentioned above and may be made from a flexible plastic, flexible metal wire with memory retention, and/or twine material.

The card 4 includes a securement structure **60*b*. In the illustrated embodiment, the securement structure takes the form of a retaining member 60*b* having tabs 62*b* and 64*b* and center portion 66*b* (obstructed from view by card 4). Tabs 62*b* and 64*b* and center portion 66*b* form a one-piece unitary structure. Tabs 62*b* and 64*b* each form a trapezoidal shape that substantially resembles the shape of a blade to be carried by blade holders 36 and/or 38. Unlike the previous embodiment of the retaining member 60 shown in FIG. 5, no notches need to be provided on the retaining member 60*b* of the illustrated embodiment. It is contemplated that in either embodiments of the retaining member 60 or 60*b*, no notches need to be provided thereon. In some embodiments, it is contemplated that the retaining member 60*b* may have a similar construction as retaining member 60 described above. The retaining member 60*b*** may be made out of cardboard, paper, plastic, metal, or other suitable material of suitable strength and flexibility.

In the illustrated embodiment, the card 4 includes the opening 44 that is constructed and arranged to enable the card 4 to be hung on a rack (not shown). In this embodiment, the opening 44 may be positioned to be offset from the center of the card 4 in the horizontal direction (e.g., the opening 44 is closer to the right edge 67 than the left edge 69 of the card 4). The opening 44 may be formed by aligning openings provided on the front portion 25 of the card 4 and the back portion 27 of the card. As such, when a projection (not shown) of the rack is inserted through the opening 44 to hang the card 4, the projection may be inserted through both the front portion 25 and the back portion 27 of the card 4.

FIG. 8 illustrates the knife 6 secured to the card 4 having the embodiment shown in FIG. 7. Referring to FIG. 8, the top surface 12 of the knife 6 is disposed at an angle relative to the front side 8 of the card 4. Otherwise stated, a plane that bisects the knife 6 longitudinally and vertically (e.g., a plane that extends longitudinally between the two slides 20 and 22 and also the blades associated therewith) is disposed at an angle with respect to a plane defined by the front surface 8 of card 4. This angle, in one embodiment, can be a right angle as shown in FIG. 1. However, in the embodiment of FIGS. 7-10, the angle may be between 30 degrees and 50 degrees. The angle should be greater than 0 degrees (where the plane bisecting the slides 20 and 22 is parallel to front card surface 8). In one embodiment, the angle is between 20 degrees and 90 degrees. It should be appreciated that this discussion is referencing the angle when considering the acute angles between the plane and the card 4. It will be understood by those skilled in the art reading this specification that the obtuse angles can also be considered, but that this is unnecessary from a standpoint of understanding. To mount knife 6 on card 4 such that top surface 12 is visible when viewing the front side 8 of the card 4 from an angle normal thereto, tabs 62*b* and 64*b* (shown in FIG. 7) may be folded along creases 70*b* and 72*b* (shown in FIG. 7), respectively, such that the retaining member 60*b* (shown in FIG. 7) is in a generally 'U' shape configuration. Knife 6 may be placed on card 4 such that knife blade openings 34 (shown in FIG. 2) face the top edge 65 of card 4. Referring to FIG. 7, tab 62*b* may be inserted through elongated hole 40*b* from the back side 10. Tab 64*b* may be inserted through elongated hole 42*b*, also from the back side 10 of card 4. Tabs 62*b* and 64*b* may be inserted through blade openings 34 (shown in FIG. 2) at the front end of the knife body 11 to engage the knife 6. Another securement structure in the form of the tie 50*b* may tie the handle portion 30 to card 4. The tie 50*b* may be inserted through the through-hole 52 (see FIG. 2) to secure the handle portion 30 to card 4. While two securement structures are shown in this embodiment, it is contemplated that only one, or more than two may be used.

As shown in FIGS. 9*a*-9*b*, when viewed from a viewing angle that is normal or perpendicular to the front surface 8 of the card 4, both slides or slide buttons 20 and 22 are visible. The holes 40*b*, 42*b* are longitudinally aligned and positioned relative to one another such that the retaining member 60*b* can be inserted through the holes 40*b*, 42*b* to retain the knife 6 in the position shown in FIGS. 9*a*-9*b*. Portions of the knife 6 may be supported by the support structure 78 (obstructed from view by the knife 6).

As mentioned above, and shown in the embodiment of FIG. 9*a*, the front portion 25 of the card 4 and the back portion 27 of the card 4 may be a unitary structure (e.g., one piece of material) folded at edge 67 to form the front portion 25 and the back portion 27. The extending portion 73 of the blister pack (obstructed from view by the front portion 25) may extend between the front portion 25 and the back portion 27 to retain the blister pack 78 on the card 4. The front portion 25 and the back portion 27 of the card 4 may be adhered or secured together, as shown in FIG. 9*b*, to retain the extending portion 73 of the blister pack 78 extending between the front portion 25 and the back portion 27. The front portion 25 and the back portion 27 may be adhered or secured together before the knife 6 is secured to the card 4 or before the knife 6 and the card 4 are hung on a rack for display. In one embodiment, the front portion 25 and the back portion 27 of the card 4 may be adhered or secured together using adhesive materials, staples, pins, stitches, or other attaching mechanisms. The front portion 25 and the back portion 27 may also be secured together using the tie 50*b* that is constructed and arranged to be inserted through both the front portion 25 and the back portion 27. The front portion 25 and the back portion 27 of the card 4 may optionally be heat sealed to retain the extending portion 73 of the blister pack 78 between the front portion 25 and the back portion 27.

As noted above, utility knife 6 may be secured to display card 4 by other mechanisms as well. In one embodiment, an adhesive may be placed on card 4. Knife 6 may be secured to card 4 by placing the bottom surface 18 of knife 6 on the adhesive. In another embodiment, a transparent plastic material may be configured to the shape of knife 6 mounted on card 4. The transparent plastic may encase knife 6 and card 4 such that the top surface 12 is facing substantially the same direction as front side 8, making the slides 20 and 22 visible to a potential customer. The transparent plastic may be affixed to card 4 by a variety of mechanisms. In one embodiment, transparent plastic may be stapled to card 4. In another embodiment, transparent plastic may be affixed to card 4 by an adhesive material, such as glue. In another embodiment, transparent plastic may have an edge configured to be sealed with the edge of card 4, as is known in the art.

While in the illustrated embodiment the slides 20 and 22 are shown on what is termed a "top side" 13 of the body 11, it should be appreciated that in alternate embodiments, the slides 20, 22 may be on the side (left side or right side) of the body 11. While slides 20, 22 are shown immediately adjacent to one another (e.g., less than ¼" when they are longitudinally aligned with one another, or optionally less then ⅛"), in an alternate embodiment, they may be spaced from one another (e.g., greater than ¼" or greater than ½").

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment may be combined with one or more features of any other embodiment.

What is claimed is:

1. A knife package comprising:

a card having a front side and a back side;

a utility knife having a body including a first side, a plurality of blade holders movable within the body, and a plurality of slides provided on the first side of the body, each slide operatively connected with one of the blade holders, the slides being arranged to move associated blade holders in the body;

a securement structure that secures the utility knife to the card, wherein said utility knife is secured on the front side of said card by the securement structure such that the plurality of slides and the first side of the utility knife are visible when viewing the front side of the card from an angle normal to the front side of the card; and a support structure projecting outwardly from the card and disposed between the card and the knife body, wherein the knife is secured on the front side of the card such that a plane that bisects the knife longitudinally and vertically is disposed at an angle between 20° and 90° with respect to a plane defined by the front side of the card, and wherein the support structure is constructed and arranged to support the utility knife at the angle.

2. The package according to claim 1, wherein said securement structure is a retaining member having tabs configured to be inserted through holes in said card into one or more knife blade openings of said knife.

3. The package according to claim 1, wherein said securement structure is a tie configured to be threaded through a pair of holes in said card and secure said knife to said card.

4. The package according to claim 1, wherein said securement structure is a plastic molding configured to encase said card and said knife such that the top surface of said knife is facing substantially the same direction as the front side of said card.

5. The package according to claim 1, wherein said securement structure is an adhesive material on the front side of said card.

6. The package according to claim 5, wherein a bottom surface of said knife is placed on the adhesive material to secure said knife on said card.

7. The package according to claim 1, wherein the support structure is a blister pack.

8. The package according to claim 1, wherein the slides are spaced less than ¼ inches apart from one another when they are longitudinally aligned.

9. The package according to claim 1, wherein the knife is secured on the front side of the card such that a plane that bisects the knife longitudinally and vertically is disposed at a right angle with respect to a plane defined by the front side of the card.

10. The package according to claim 1, wherein the knife is secured on the front side of the card such that a plane that bisects the knife longitudinally and vertically is disposed at an angle between 30° and 50° with respect to a plane defined by the front side of the card.

11. The package according to claim 1, wherein the plane that bisects the knife is disposed parallel to and between the planes in which blades held by the blade holders lie.

12. A knife package comprising:

a card having a front side, a back side, and at least two holes;

a knife having a body carrying a plurality of blade holders, each blade holder capable of holding a blade, the body having a plurality of knife blade openings through which the blades can be moved between 1) a stored position within the body and 2) a deployed position wherein the blades protrude outside of the body; and a retaining member having tabs configured to be inserted through said holes in the card and into said knife blade openings to secure said knife along said card.

13. The package according to claim 12, further comprising a tie configured to be threaded through a pair of holes in said card and secure said knife to said card.

14. The package according to claim 12, wherein the tabs have one or more indentations configured to engage one or more blade holders of said knife.

15. The package according to claim 12, wherein the tabs have ends that may be folded to increase thickness of the tabs.

16. The package of according to claim 12, wherein the tabs have trapezoidal shapes resembling blades.

17. The package according to claim 12, further comprising a support structure constructed and arranged to support at least a portion of the knife.

18. The package according to claim 17, wherein the support structure is a blister pack.

19. A knife package comprising:

a card having a front side and a back side;

a utility knife having a body, a plurality of blade holders movable within the body, and a plurality of slides on the body, each slide operatively connected with one of the blade holders, the slides being arranged to move associated blade holders in the body; and a securement structure that secures the utility knife to the card, wherein said utility knife is secured on the front side of said card by the securement structure such that the plurality of slides of the utility knife are visible when viewing the front side of the card from an angle normal to the front side of the card, wherein said securement structure is a retaining member having tabs configured to be inserted through holes in said card into one or more knife blade openings of said knife.

20. The package according to claim 7, wherein the blister pack is constructed from a clear plastic material.

21. The package according to claim 1, wherein the support structure does not surround the knife body.

* * * * *